US008701740B2

(12) United States Patent
Navarro et al.

(10) Patent No.: US 8,701,740 B2
(45) Date of Patent: Apr. 22, 2014

(54) DEVICE FOR HANGING A CURTAIN IN FRONT OF A WINDOW

(76) Inventors: José Navarro, Montauban (FR); Edouard Navarro, Montauban (FR)

( * ) Notice: Subject to any disclaimer, the term of this patent is extended or adjusted under 35 U.S.C. 154(b) by 290 days.

(21) Appl. No.: 13/158,909

(22) Filed: Jun. 13, 2011

(65) Prior Publication Data

US 2011/0290962 A1 Dec. 1, 2011

Related U.S. Application Data

(63) Continuation-in-part of application No. 12/299,645, filed as application No. PCT/IB2007/001153 on May 4, 2007, now abandoned.

(30) Foreign Application Priority Data

May 5, 2006 (FR) ..... 06 04038

(51) Int. Cl.
*A47H 1/10* (2006.01)

(52) U.S. Cl.
USPC ..... 160/333; 160/335; 160/92; 160/95; 248/262

(58) Field of Classification Search
USPC ..... 160/333, 334, 335, 337, 95, 96, 92; 248/261, 265, 254, 262, 103
See application file for complete search history.

(56) References Cited

U.S. PATENT DOCUMENTS

| | | | | |
|---|---|---|---|---|
| 1,509,098 | A | 9/1924 | Monroe | |
| 1,819,965 | A | 8/1931 | Wilhelm | |
| 2,605,069 | A * | 7/1952 | Gillaspy | 248/103 |
| 3,627,244 | A * | 12/1971 | Nicholas | 248/103 |
| 3,668,739 | A * | 6/1972 | Lewis | 452/194 |
| 6,367,755 | B1 | 4/2002 | Arena | |
| 6,499,186 | B1 | 12/2002 | Arentsen | |
| 6,598,837 | B1 * | 7/2003 | Howard et al. | 248/103 |
| 2009/0173457 | A1 * | 7/2009 | Navarro et al. | 160/330 |
| 2011/0001022 | A1 * | 1/2011 | Edinger | 248/103 |
| 2011/0290962 | A1 * | 12/2011 | Navarro et al. | 248/201 |

FOREIGN PATENT DOCUMENTS

| | | |
|---|---|---|
| FR | 5501 E | 11/1905 |
| FR | 770527 | 9/1934 |
| FR | 2448329 | 9/1980 |

* cited by examiner

*Primary Examiner* — Blair M. Johnson
(74) *Attorney, Agent, or Firm* — Young & Thompson

(57) ABSTRACT

The device includes two sub-assemblies (1) for mounting the rail (2) for supporting the curtain on the leaves (3) of the window, each sub-assembly having a plate (5) and an offset arm (6). The plate is formed so as to be able to be fixed to the upper edge of a leaf (3), in the vicinity of the pivot axis thereof, and includes mounting elements (14) for pivotably mounting the offset arm thereon, along an axis extending, after mounting on the leaf (3), parallel to the pivot axis of the leaf. The offset arm (6) is formed to offset the rail (2) relative to the wall; it is pivotably mounted on the plate (5) by the mounting elements and is pivotably connected to the rail (2) at a point thereof which is longitudinally fixed, also along an axis parallel to the pivot axis of the leaf (3).

20 Claims, 3 Drawing Sheets

DEVICE FOR HANGING A CURTAIN IN FRONT OF A WINDOW

CROSS REFERENCE TO RELATED APPLICATIONS

This application is a continuation-in-part of application Ser. No.: 12/299,645 filed on Nov. 5, 2008; which is the 35 U.S.C. 371 national stage of International application PCT/IB2007/001153 filed on May 4, 2007; which claimed priority to French application 06/04038 filed May 5, 2006. The entire contents of each of the above-identified applications are hereby incorporated by reference.

BACKGROUND OF THE INVENTION

The present invention relates to a device for hanging a curtain in front of a window.

The term "curtain" should be understood in the widest sense of the word, i.e. as referring to any type of means which can cover a window, including for example a blind. The same applies to the term "window", which should be understood to refer to a double casement window proper or to openings similar to windows, such as a glass door, for example.

Similarly, the "rod" mentioned below should be understood to encompass a rod, a bar or a rail for supporting one or more curtains or the like.

To hang a curtain in front of a window, it is currently necessary to fix the rod for supporting the curtain to the wall, which means that holes need to be drilled and the rod screwed in place by suitable means. These fixing operations are relatively complex to perform and have the disadvantage that holes need to be made in the wall.

The object of the present invention is to overcome this fundamental disadvantage.

The document U.S. Pat. No. 1,819,965 describes a system for mounting a curtain rod in front of a door, including two sub-assemblies for mounting the rod on the door, each sub-assembly comprising a mounting plate and an offset arm connected pivotably to the plate, on the one hand, and to the rod, on the other hand. The two offset arms and the rod form a deformable parallelogram which allows the rod to be displaced relative to the door when the latter is opened. The end of the rod which is situated on the hinge side of the door and which protrudes beyond the door thus does not obstruct the door from opening.

It is not possible to mount a curtain in front of a window using this system.

The device which is the subject of the invention comprises, in a manner known per se, two sub-assemblies for mounting a rod for supporting the curtain, each sub-assembly comprising a plate and an offset arm.

According to the invention, each plate comprises a mounting part adapted so that it can be fixed over the upper edge of a casement frame, a lateral extension which can project beyond the side of the casement frame when the plate is fixed to the latter, and a pivoting means integral with this lateral extension, defining an axis of pivoting; a first plate is intended to be mounted on a first casement frame such that the axis of pivoting defined by the pivoting means which this first plate comprises is coaxial with the axis of pivoting of the casement frame, and the second plate is intended to be mounted on the second casement frame such that the axis of pivoting defined by the pivoting means which this second plate comprises is coaxial with the axis of pivoting of the casement frame;

each offset arm comprises, at a first end, a pivoting means which can interact with the pivoting means of a corresponding plate such that this offset arm can be mounted on this plate with the possibility of pivoting about the said axis of pivoting; at its other end, each offset arm comprises a means of connection to the rod, there being no possibility of this arm pivoting relative to this rod.

The plate of each sub-assembly is thus fixed over the upper edge of a window casement frame, and each offset arm is mounted so as to pivot on the corresponding plate, the two offset arms supporting the rod.

The rod is thus mounted directly on the casement frames of the window and no longer on the wall. By virtue of the mounting of the plates on the upper edge of the casement frames, the said sub-assemblies extend upwards relative to the casement frames, and by virtue of the pivoting mounting of the offset arms relative to the plates and to the rod, these sub-assemblies do not obstruct the opening of a casement frame or of both casement frames over a wide range that can be up to 180 degrees or even higher.

The pivoting means which each plate comprises preferably consists of a stub integral with the plate and the pivoting means which each offset arm comprises consists of a bore formed in each offset arm, this bore allowing the offset arm to engage in pivoting fashion on the stub.

The said lateral extension which each plate comprises can be part of the said mounting part which this same plate comprises; the said lateral extension can also be formed on a piece which is separate from the said mounting part and can be connected to this mounting part, and each plate comprises means for adjusting the position of the said lateral extension relative to the said mounting part.

These adjustment means can thus be adjusted such that the axis of pivoting of the offset arm coincides with the axis of pivoting of the casement frame on which the plate is mounted, and consequently making it possible to obtain perfect coaxiality between the pivoting means which the said lateral extension comprises and the axis of pivoting of the casement frame.

When a casement frame comprises an upper rabbet, the plate intended to be fixed on this casement frame is preferably shaped and dimensioned so that it can be engaged in overlapping fashion over the projecting edge of the casement frame which defines the rabbet and adjusted.

A rigid mounting of the sub-assembly relative to the casement frame is thus obtained.

Advantageously, each plate comprises a tapped bore which can receive a pressure screw capable of bearing against the casement frame without penetrating into the material of the latter.

The immobilizing of the plate relative to the casement frame is thus obtained without there being any need to pierce the casement frame.

The said connection means which each offset arm comprises for its connection to the rod advantageously comprises means for adjusting the position of the offset arm relative to the rod, making it possible to obtain a plurality of fixed angular positions of this offset arm relative to this rod.

The distance of the rod relative to the wall can thus be adjusted by placing the offset arms in such or such a particular position relative to the rod. The offset arms are of course placed in positions where each offset arm is at the same angle relative to the rod such that the rod is parallel to the wall.

According to a preferred embodiment of the invention, in this case the said connection means comprises a cavity formed in the upper end of an offset arm, and a series of radial housings formed in the offset arm and opening out into this cavity, and the device comprises two pieces joining the offset arms to the rod, each comprising a pivot provided with a radial catch, it being intended that this pivot is accommodated in the said cavity and it being intended that this catch is engaged in one or other of the said radial housings and adjusted so as to immobilize the offset arm in a particular angular position relative to the joining piece and hence relative to the rod.

The invention will be understood and its other features and advantages will become apparent with reference to the attached drawings which show, by way of non-limiting examples, two possible embodiments of the device to which it relates.

In the description below, the parts or elements which reappear in different embodiments are designated by the same reference numerals and are not described again.

FIGS. 1 to 4 show a device for hanging one or two curtains in front of a window, comprising two sub-assemblies 1 for mounting a rod 2 for supporting the curtain or curtains (not shown) on the casement frames 3 of the window.

Figure 1:
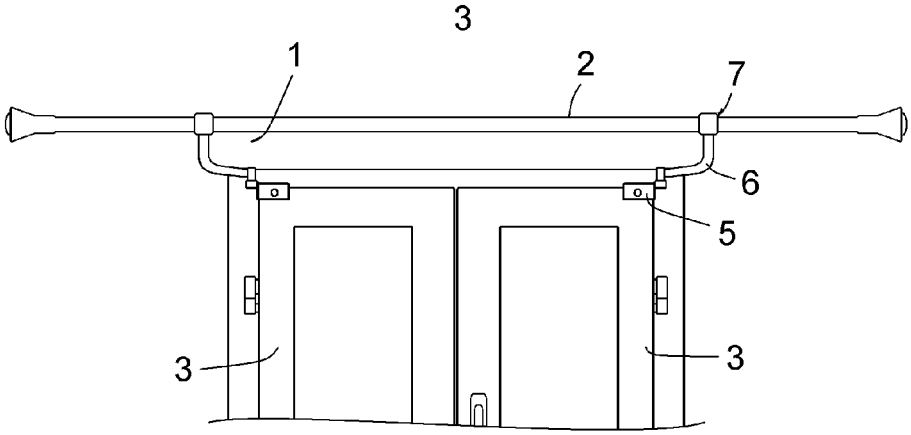
FIG. 1 is a general side view, according to a first embodiment, of the invention installed on two casement frames of a window, these casement frames being closed.
Figure 2:
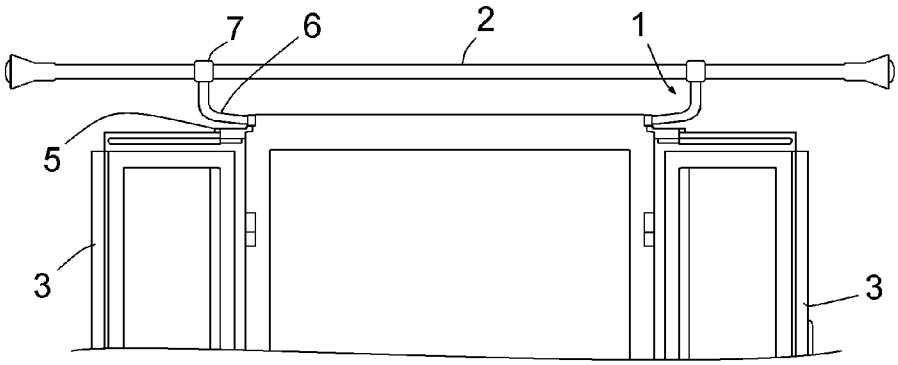
FIG. 2 is a similar view to FIG. 1, the two casement frames of the window being open.
Figure 3:
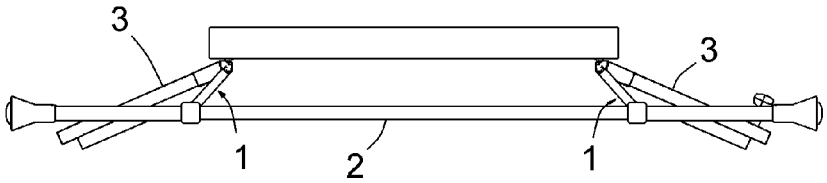
FIG. 3 is a top view of the device, the two casement frames of the window being open.
Figure 4:
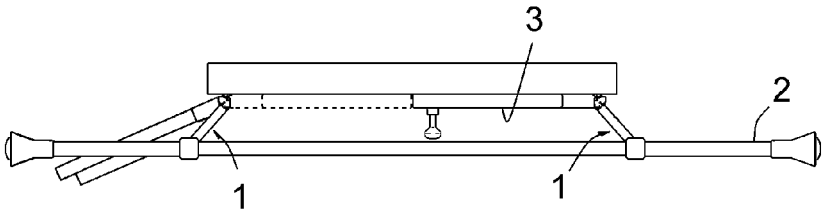
FIG. 4 is a similar view to FIG. 3, one of the two casement frames of the window being open, whilst the other is closed; the right-hand casement frame being in the closed position, whilst the left-hand casement frame is shown in the closed position in broken lines and in the open position in solid lines.
Figure 5:
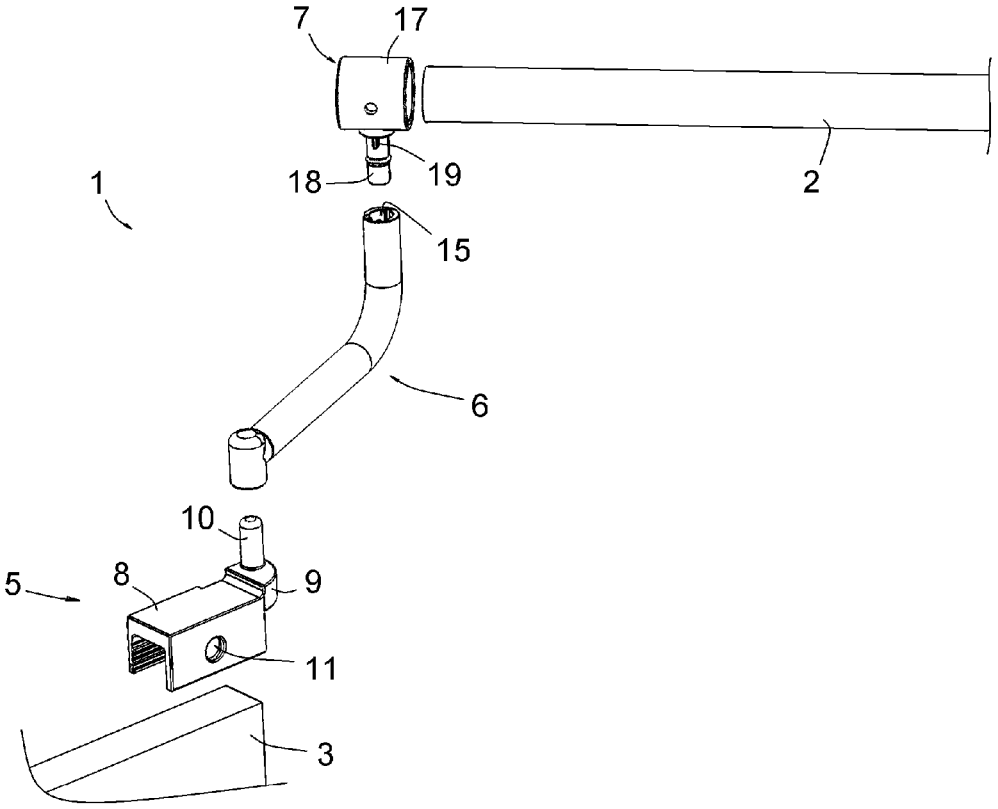
FIG. 5 is an exploded perspective view of one of the two sub-assemblies which this device comprises.
Figure 6:
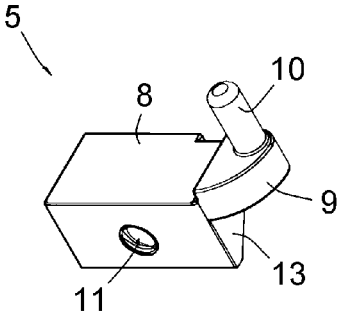
FIG. 6 is a perspective view of a mounting piece which the device comprises.
Figure 7:
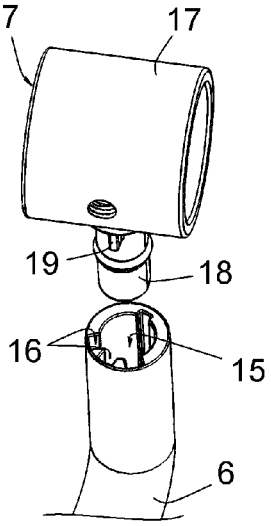
FIG. 7 is a perspective view of a rod mounting piece and of the upper end of an offset arm which the device comprises.

One of the two sub-assemblies 1 can be seen on an enlarged scale in FIG. 5. The two sub-assemblies 1 have identical structures, except that they are symmetrical about the central vertical plane of the window.

As can be seen in FIG. 5, each sub-assembly 1 comprises, in the example shown, a plate 5 for mounting on the casement frame 3, an offset arm 6 and a piece 7 for joining the offset arm 6 to the rod 2.

The plate 5 comprises a mounting part 8 adapted to be fixed on the upper edge of a casement frame 3, a lateral extension 9 which can project beyond the side of the casement frame 3 when the plate 5 is fixed to the latter, and a pivot stub 10 integral with this lateral extension 9.

The mounting part 8 comprises a plane and rectangular central part and two wings which are folded back at right angles relative to this central part and extend from two opposite longitudinal edges of this central part. As may be understood, the plate 5 can be engaged in overlapping fashion on the edge of the casement frame 3 and adjusted.

One of the bent-back wings of the mounting part 8 comprises a tapped bore 11 which receives a pressure screw in the form of a threaded metal cylinder. This pressure screw is able to bear against the casement frame 3 without penetrating into the material of the latter, allowing the plate 5 to be immobilized relative to the casement frame 3 without there being any need to pierce the casement frame 3.

The other bent-back wing of the mounting part 8 is ridged so that it is retained on the upper edge of the casement frame 3.

Below the lateral extension 9, the mounting part 8 comprises a transverse wall 13 which abuts against the upper edge of the casement frame 3.

The lateral extension 9 is part of the mounting part 8, and the stub 10 is part of this extension 9.

As may be understood with reference to FIGS. 1 to 4, the mounting part 8 of a first plate 5 is adapted so as to be fixed on the upper edge of a casement frame 3, with the lateral extension projecting beyond the side of this casement frame 3, such that the axis of pivoting defined by the stub 10 of this plate 5 is coaxial with the axis of pivoting of the casement frame 3; the second plate 5 is intended to be mounted on the second casement frame 3 such that the axis of pivoting defined by the stub 10 which this second plate 5 comprises is coaxial with the axis of pivoting of this second casement frame 3.

The offset arm 6 has a double-angled shape distinguishing a slightly inclined central part and two end portions which face in opposite directions and have axes that are parallel to each other. As can be seen in FIGS. 1 to 4, when this arm is mounted on a plate 5 which is itself mounted on a casement frame 3, this shape allows the offset arm 6 to offset the rod 2 relative to the wall in which the window is formed.

Figure 8:
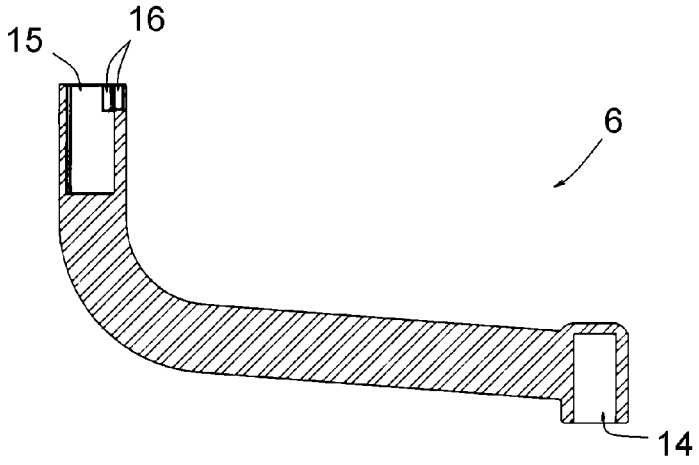
FIG. 8 is a view in longitudinal section of this offset arm.

The lower end portion of the arm 6 comprises a bore 14 (cf. FIG. 8) which makes it possible to mount the arm 6 on the stub 10 so that it can pivot.

In its upper end portion, the arm 6 comprises a cylindrical cavity 15 and a series of radial housings 16 formed in the offset arm 6 and opening out into this cavity 15.

Each joining piece 7 comprises a sleeve 17 which can be engaged and adjusted on the rod 2, and a finger 18 forming a pivot provided with a radial catch 19. This catch 19 is intended to be engaged and adjusted in one or other of the said radial housings 16 so as to immobilize the offset arm 6 in a particular angular position relative to the joining piece 7 and hence relative to the rod 2, there being no possibility of this arm 6 pivoting relative to this rod 2.

The sleeve 17 also comprises an axial tapped bore 21 into which a pressure screw can be engaged, allowing the rod 2 to be immobilized longitudinally relative to the sleeve 17.

As shown in FIGS. 1 to 4, when the casement frames 3 pivot, the offset arms 6 and the rod 2 do not move in space owing to the fact that the axes of pivoting of these offset arms coincide with the axis of pivoting of the casement frames 3.

Thus, with the device according to the invention, the rod 2 for supporting the curtain or curtains is mounted directly on the casement frames 3 of the window and not on the wall, and the sub-assemblies 1 for supporting the rod 2 do not obstruct the opening of a casement frame 3 or of both casement frames 3 to a large width, and in so doing the rod 2 is held in a position substantially parallel to the wall and in a position substantially centred relative to the window.

Figure 9:
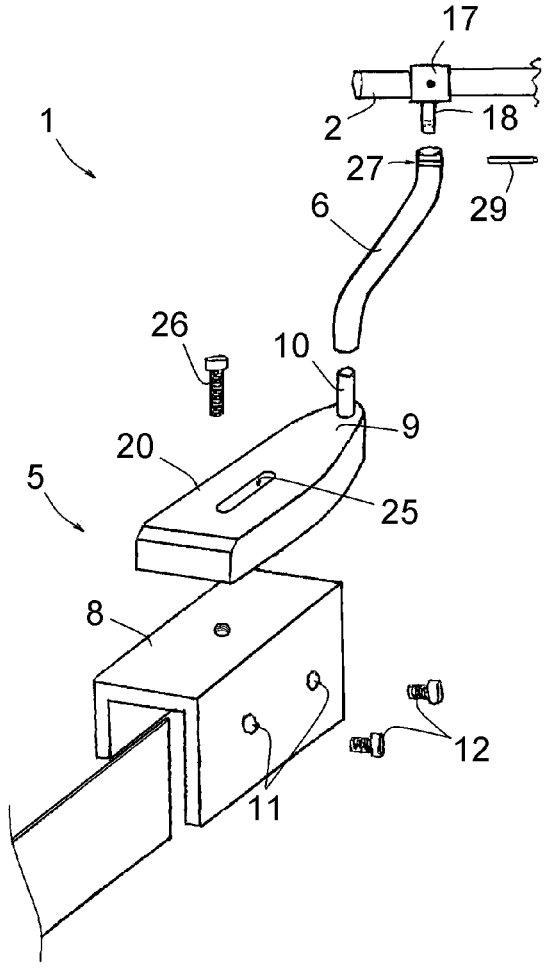
FIG. 9 is an exploded perspective view of one of the sub-assemblies of the device according to a second embodiment.

FIG. 9 shows a device in which each plate 5 is in two parts, the lower part forming the said mounting part 8, fixed by screws 12, and the upper part forming the said lateral extension 9 as well as a main part 20 for assembling with the piece 8 with the possibility of adjusting its position relative to the latter. This adjustment allows the axis of pivoting of the offset arm 6 to coincide exactly with the axis of pivoting of the casement frame 3 on which the plate 5 is mounted. In the example shown, this adjustment is effected by means of a slot 25 formed in the part 20 and a screw 26 engaged in this slot 25 and then in a tapped bore formed in the part 8. Once the parts 8 and 20 have been suitably positioned, the screw 26 is tightened. A groove and a rib (which are not shown) which are parallel to the slot 25 can be formed in the parts 8 and 20 in order to lock the part 20 longitudinally relative to the part 8.

In this case, the finger 18 of each sleeve 17 and the upper end of each offset arm 6 each comprise a hole 27 for receiving a pin 29.

As a result of these arrangements, the rod 2 is perfectly parallel to the wall irrespective of the positions of the casement frames 3.

The invention consequently provides a device with the decisive advantage of being able to be installed using fixing methods which are relatively simple and quick to use, with there being no need to make holes in the wall; when the device comprises plates 5 and pressure screws 12 as described above, the mounting of this device does not require holes to be drilled in the casement frames 3.

It goes without saying that the invention is not limited to the embodiment described above by way of example but extends to all the embodiments covered by the attached claims.

The invention claimed is:

1. A device for hanging a curtain in front of a window, comprising:

a curtain rod (2) for supporting a curtain; and two sub-assemblies (1), each said sub-assembly (1) comprising a plate (5) and an offset arm (6), wherein, a first of the sub-assemblies mounts to a first casement window frame and a second of the sub-assemblies mounts to a second casement window frame, an upper edge of each said casement window frame being defined by a top edge of the casement window frame and a side edge of the casement window frame, each said casement window frame (3) having a pivoting axis, each plate (5) comprises a mounting part (8) that fits on the upper edge of one of the casement window frames (3), the mounting part (8) comprises i) a lateral extension (9) that, with the mounting part (8) fitted on the upper edge of the casement window frame, projects beyond the side edge of the one casement window frame (3), and ii) a pivoting element (10) integral with the lateral extension (9), the pivoting element defining a pivoting axis coaxial with the pivoting axis of the one casement window frame (3), and each offset arm (6) comprises i) a first end and an opposite second end, ii) at the first end, a pivoting part (14), each said offset arm (6), with the pivoting part (14) mounted on the pivoting element (10) of a corresponding one of the plates (5), being pivotable with respect to said pivoting axis of said pivoting element, and iii) at the second end, a connection part (15, 16) that connects the offset arm (6) to the rod (2) such that the second end of the offset arm (6) is non-pivotable with respect to the rod (2).

2. The device according to claim 1, wherein, the pivoting element of each said lateral extension (9) comprises a stub (10) integral with said lateral extension (9), and the pivoting part (14) of each said offset arm (6) comprises a bore (14) that mounts, in a pivoting manner, on the stub (10).

3. The device according to claim 1, wherein each said lateral extension (9) is an integral part of each said mounting part (8).

4. The device according to claim 1, wherein, each said lateral extension (9) is formed on a support piece (20) which is separate from each said mounting part (8) and is connected to each said mounting part (8), and each support piece (20) comprises an adjustment element (25, 26) for adjusting a position of the said lateral extension (9) relative to the said mounting part (8).

5. The device according to claim 1, wherein each said plate (5) is shaped and dimensioned to be adjustably engaged in overlapping fashion over a projecting edge of the casement window frame (3), the projecting edge of the casement window frame defining a rabbet.

6. The device according to claim 1, wherein each said plate (5) comprises a tapped bore (11) which can receive a pressure screw (12).

7. The device according to claim 1, wherein the said connection part comprises a position-adjusting part (16, 19) for adjusting the position of the offset arm (6) relative to the rod (2), to obtain a plurality of fixed angular positions of each offset arm (6) relative to the rod (2).

8. The device according to claim 7, wherein the said connection part comprises a cavity (15) formed in an upper part of the second end of the offset arm (6), and a series of radial housings (16) opening out into the cavity (15), and the device further comprising two joining pieces (7) joining the offset arms (6) to the rod (2), each joining piece comprising a pivot (18) provided with a radial catch (19), said pivot (18) being accommodated in said cavity (15) with said catch (19) engaged in one of said radial housings (16) so that the offset arm (6) is fixed in place in a particular angular position relative to the joining piece (7) and hence relative to the rod (2).

9. The device according to claim 2, wherein the said lateral extension (9) is a part of said mounting part (8).

10. The device according to claim 2, wherein, each said lateral extension (9) is formed on a support piece (20) which is separate from each said mounting part (8) and is connected to each said mounting part (8), and each support piece (20) comprises an adjustment element (25, 26) for adjusting a position of the said lateral extension (9) relative to the said mounting part (8).

11. The device according to claim 2, wherein each said plate (5) is shaped and dimensioned to be adjustably engaged in overlapping fashion over a projecting edge of the casement window frame (3), the projecting edge of the casement window frame defining a rabbet.

12. The device according to claim 3, wherein each said plate (5) is shaped and dimensioned to be adjustably engaged in overlapping fashion over a projecting edge of the casement window frame (3), the projecting edge of the casement window frame defining a rabbet.

13. The device according to claim 4, wherein each said plate (5) is shaped and dimensioned to be adjustably engaged in overlapping fashion over a projecting edge of the casement window frame (3), the projecting edge of the casement window frame defining a rabbet.

14. The device according to claim 2, wherein each plate (5) comprises a tapped bore (11) which can receive a pressure screw (12) capable of bearing against the casement frame (3) without penetrating into the material of the latter.

15. The device according to claim 3, wherein each said plate (5) comprises a tapped bore (11) which can receive a pressure screw (12).

16. The device according to claim 4, wherein each said plate (5) comprises a tapped bore (11) which can receive a pressure screw (12).

17. The device according to claim 5, wherein each said plate (5) comprises a tapped bore (11) which can receive a pressure screw (12).

18. The device according to claim 2, wherein the said connection part comprises a position-adjusting part (16, 19)

for adjusting the position of the offset arm (6) relative to the rod (2), to obtain a plurality of fixed angular positions of each offset arm (6) relative to the rod (2).

19. The device according to claim 3, wherein the said connection part comprises a position-adjusting part (16, 19) for adjusting the position of the offset arm (6) relative to the rod (2), to obtain a plurality of fixed angular positions of each offset arm (6) relative to the rod (2).

20. The device according to claim 1 in combination with the first and second casement window frames, and wherein the two sub-assemblies are mounted to the upper edges of the first and second casement window frames and the rod is mounted to the two sub-assemblies.

* * * * *